US006106325A

United States Patent [19]

Kuo

[11] Patent Number: 6,106,325

[45] Date of Patent: Aug. 22, 2000

[54] CABLE CONNECTOR ASSEMBLY

[75] Inventor: Peter Kuo, Chung-Ho, Taiwan

[73] Assignee: Hon Hai Precision Ind. Co., Ltd., Taipei Hsien, Taiwan

[21] Appl. No.: 09/324,604

[22] Filed: Jun. 2, 1999

[30] Foreign Application Priority Data

Dec. 31, 1998 [TW] Taiwan ..... 87222074

[51] Int. Cl.[7] ..... H01R 13/58

[52] U.S. Cl. ..... 439/455; 439/465

[58] Field of Search ..... 439/455, 465, 439/460, 466, 467, 447

[56] References Cited

U.S. PATENT DOCUMENTS

| | | | |
|---|---|---|---|
| 2,398,002 | 4/1946 | Heyman | 439/455 |
| 4,108,527 | 8/1978 | Douty et al. | 439/465 |
| 4,963,104 | 10/1990 | Dickie | 439/465 |
| 5,348,494 | 9/1994 | Falossi et al. | 439/465 |
| 5,774,980 | 7/1998 | Klein et al. | 439/465 |

*Primary Examiner*—Hien Vu
*Attorney, Agent, or Firm*—Wei Te Chung

[57] ABSTRACT

A cable connector assembly which reduces a cross sectional area of an end portion of a cable and which can be conveniently and securely assembled to a connector, comprises a main body, a cable and a clamp device. The main body has a connecting portion receiving a number of terminals for electrically connecting with a mating connector at one end and a receiving space accommodating a housing block. The cable has an electrical portion at an end portion thereof for electrically connecting with the terminals of the connecting portion. The clamp device comprising at least two clamping portions and fixing portions corresponding to the housing block is received in the receiving space and assembled to the housing block. Thus the end portion of the cable is deformed and retained by the clamping portions and secured to the housing block by the fixing portions of the clamp device.

5 Claims, 8 Drawing Sheets

CABLE CONNECTOR ASSEMBLY

BACKGROUND OF THE INVENTION

1. Field of the Invention

The present invention relates to a cable connector assembly, and particularly to a cable connector assembly which allows for the convenient and secure assembly of a cable thereto.

2. Description of Prior Art

As the trend of the computer industry continues toward miniaturization, electrical connectors are becoming increasingly compact in electronic devices having increased functional abilities and reduced volume. Thus, complementary connecting devices should also be decreased in size for mating with the related connectors. Additionally, the assembly process should be simple, efficient and substantial for improving assembly efficiency and decreasing production costs.

FIG. 1 shows a cable connector assembly disclosed in Taiwan Patent Application No. 83214112 which is related to the present invention. The cable connector assembly includes a main body 6 having a receiving recess 61 and two screw holes 62 disposed on opposite sides of the recess 61, a clamp member 7 forming an elliptical clamping portion 71 and two holes 72 on opposite sides of the clamping portion 71 corresponding to the screw holes 62 of the body 6, and a cable 8. After positioning the cable 8 within the receiving recess 61, the clamping member 7 is positioned on the body 6 whereby the clamping portion 71 abuts against the cable 8. The clamp member 7 is then attached to the body 6 by means of a bolt 63 extending through each hole 72 of the clamp member 7 and threadedly engaging with the corresponding screw hole 62 of the body 6. Thus the cable 8 is attached to the body 6 of the connector.

However, since the size of the cable doesn't change after the cable is attached to the body of the connector, the general size of the cable connector assembly is predetermined and cannot be adapted to accommodate cables of smaller size. Thus, the cable cannot be used with electronic devices having a narrower receiving recess. Furthermore, the assembly process of the prior art is laborious and the cable clamp member may not properly retain the cable therein. Hence, the cable may become loosened or disengaged from the body of the connector.

SUMMARY OF THE INVENTION

Accordingly, an object of the present invention is to provide a cable connector assembly which can accommodate cables of different sizes.

Another object of the present invention is to provide a cable connector assembly which allows for the convenient and secure assembly of a cable thereto.

In the preferred embodiment of the present invention, a cable connector assembly comprises a main body having a receiving space and a housing block fixed in the receiving space, a cable extending through the main body and having an end portion, and a clamp device being attached to the housing block and finally retaining the end portion of the cable therein.

BRIEF DESCRIPTION OF THE DRAWINGS

Other objects and advantages of the present invention will be understood from the following description of a cable connector assembly according to a preferred embodiment of the present invention shown in the accompanying drawings, in which.

DETAILED DESCRIPTION OF THE PREFERRED EMBODIMENT

Figure 1:
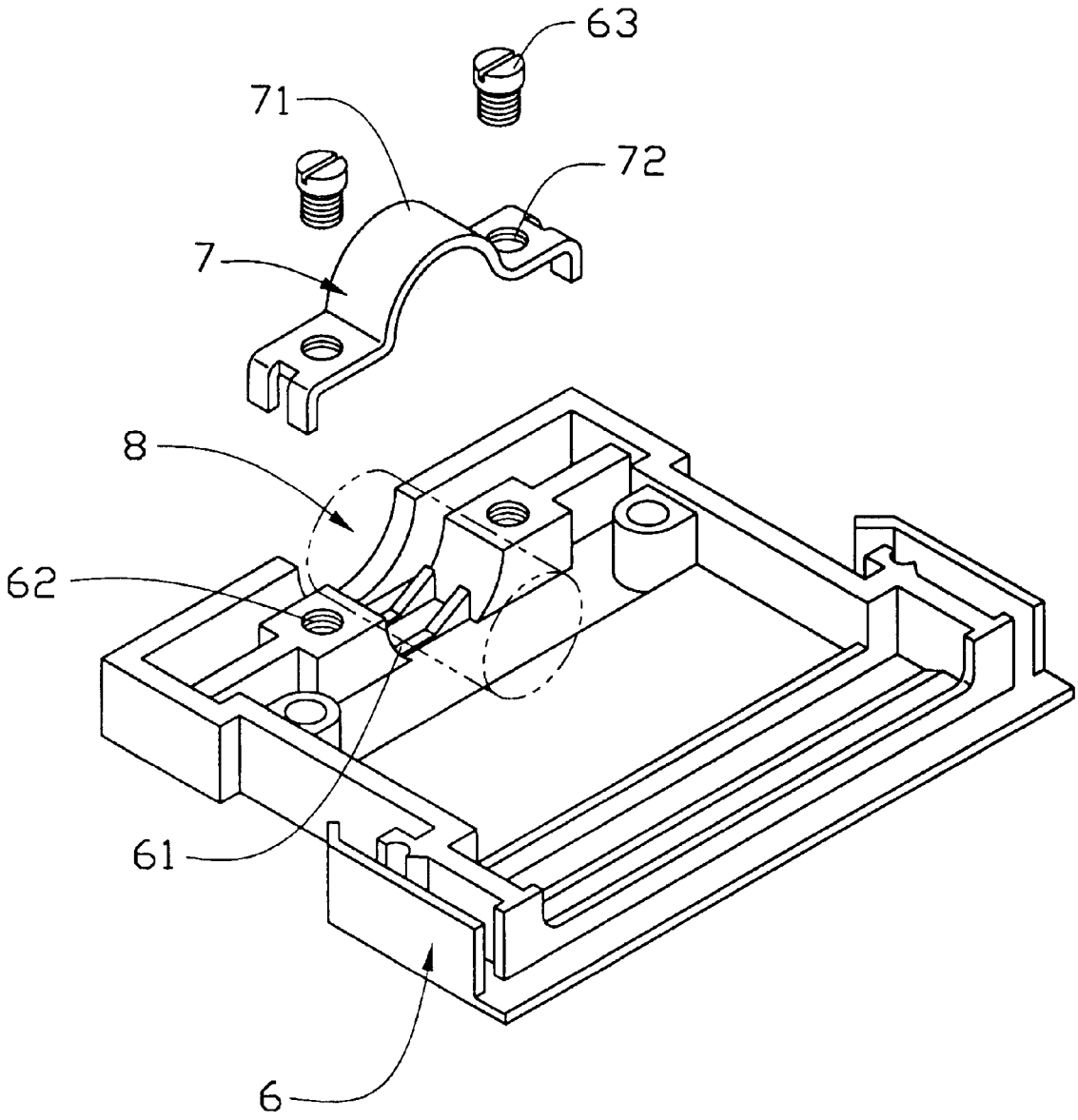
FIG. 1 (PRIOR ART)
FIG. 1 is an exploded view of a portion of a conventional cable connector assembly.
Figure 2:
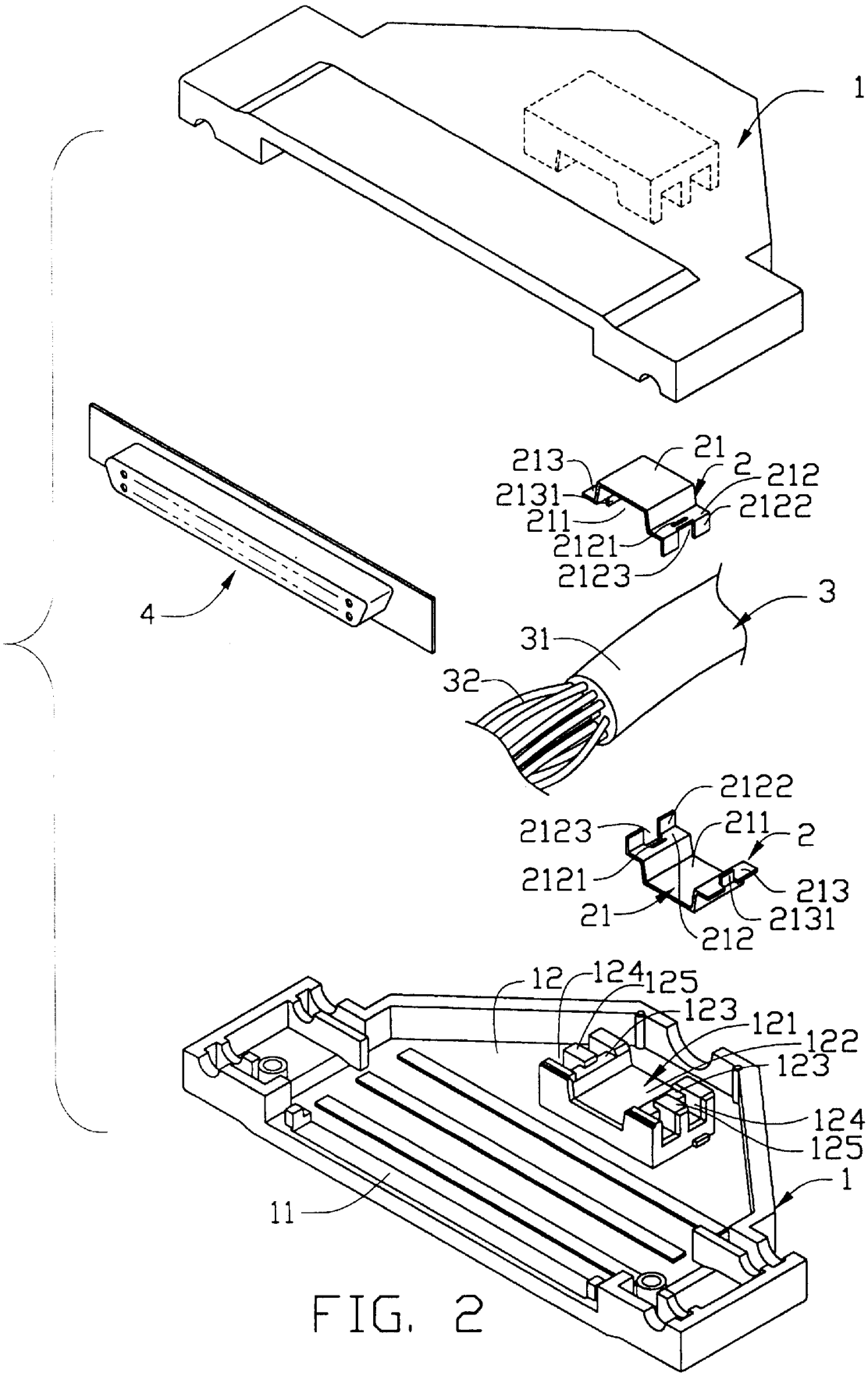
FIG. 2 is an exploded view of a cable connector assembly embodying the concepts of the present invention.
Figure 3:
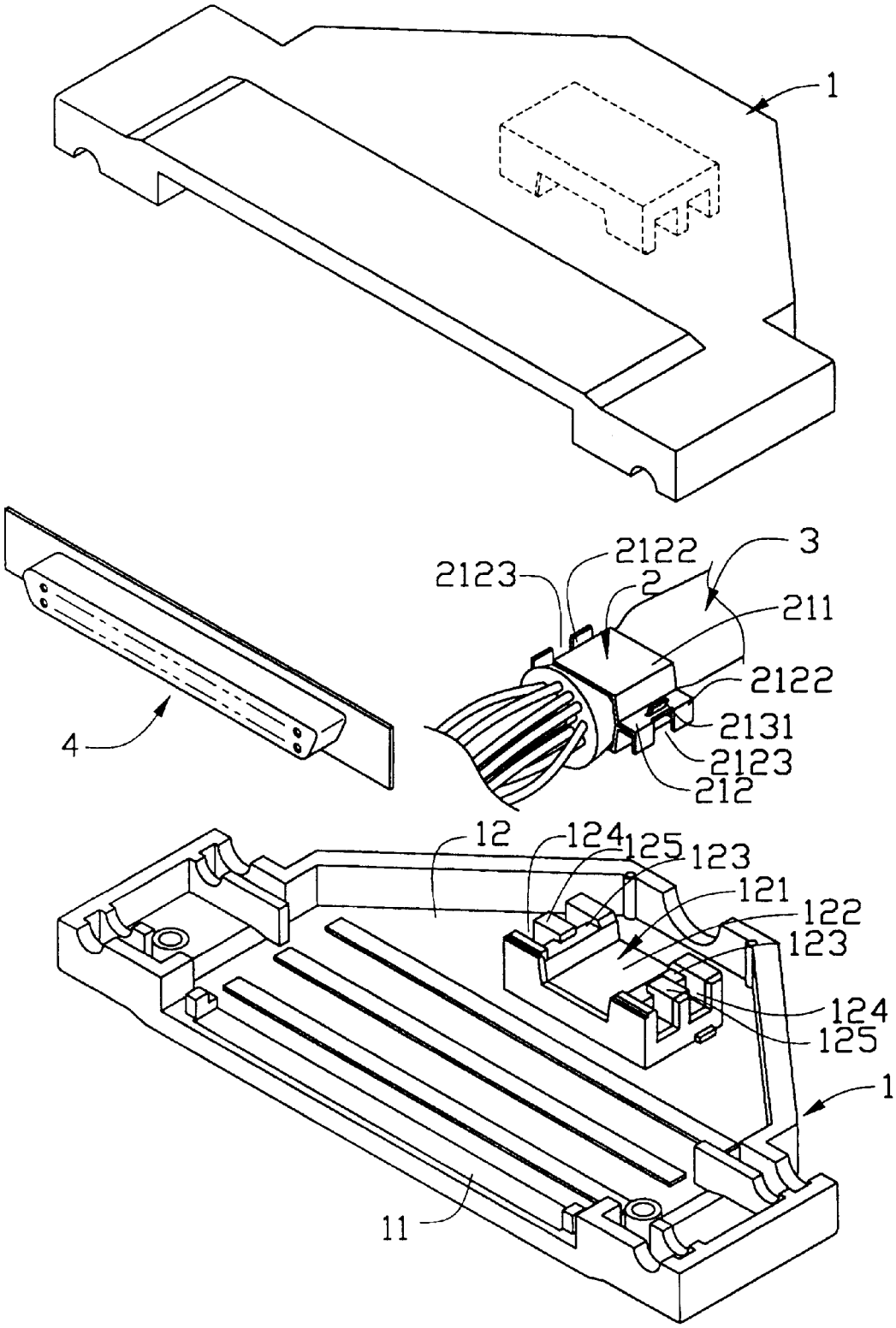
FIG. 3 is a partially assembled view of FIG. 2.
Figure 4A:
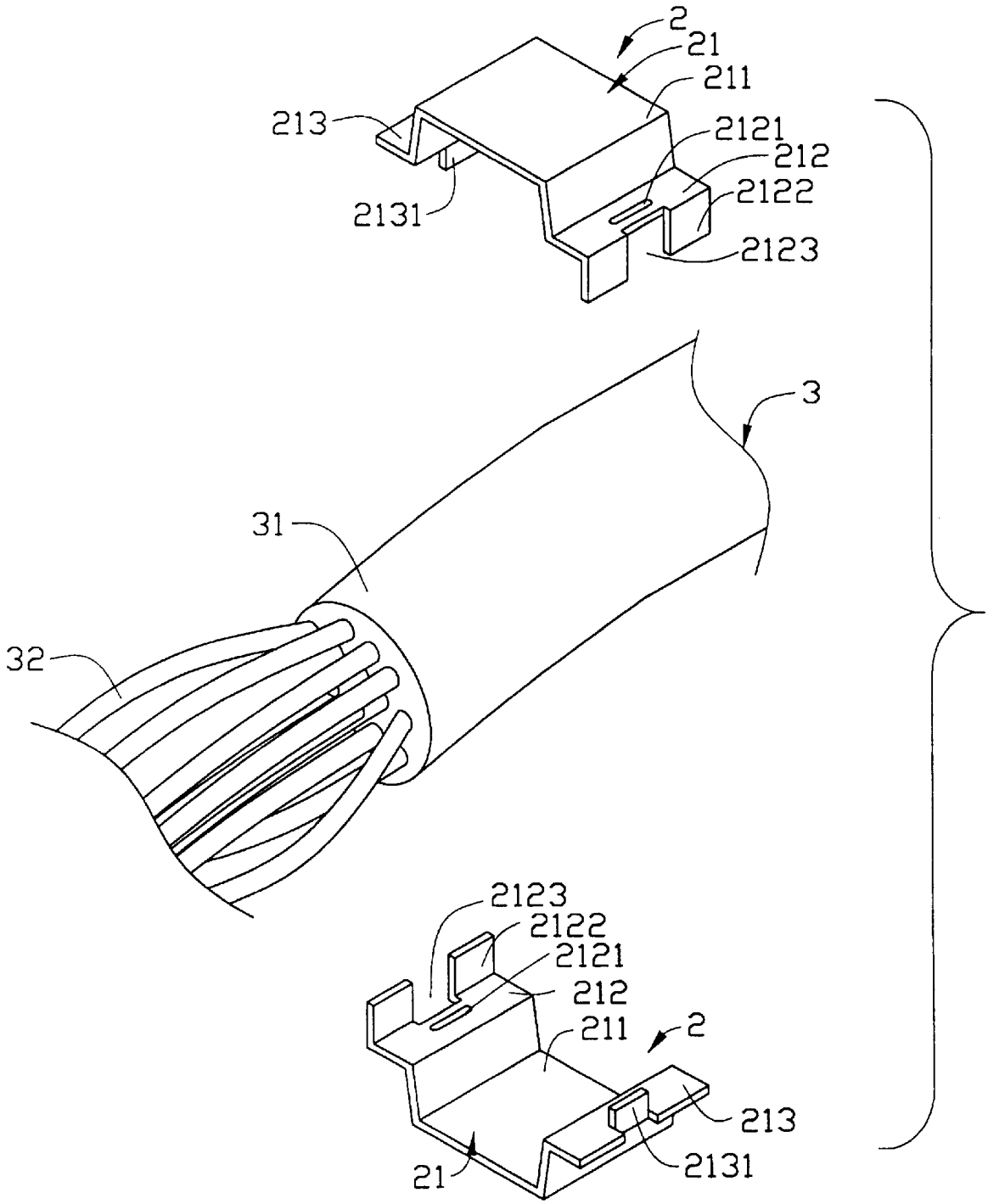
FIG. 4(A) is a perspective view of a clamp member of the cable connector assembly before being clamped to a cable.
Figure 4B:
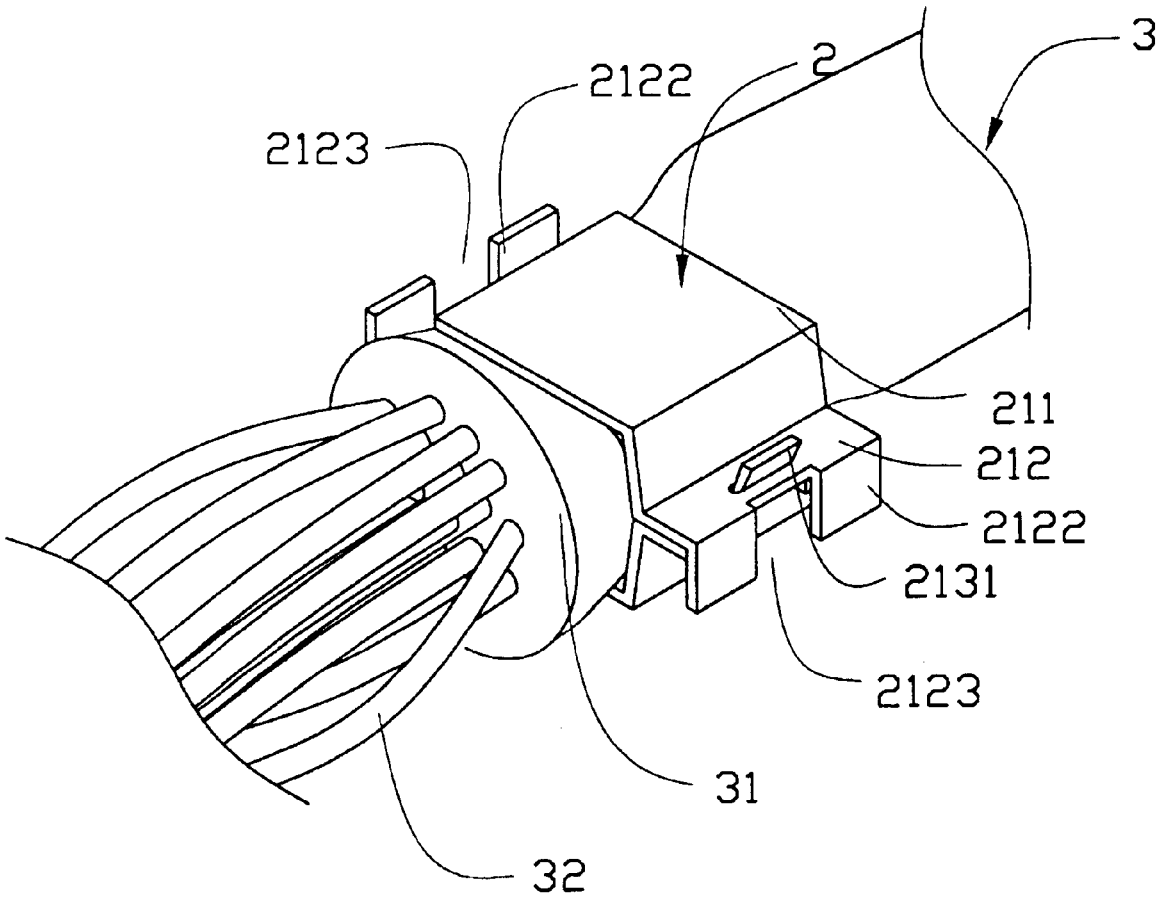
FIG. 4(B) is a perspective view of the clamp member of the cable connector assembly after being clamped to a cable.
Figure 5:
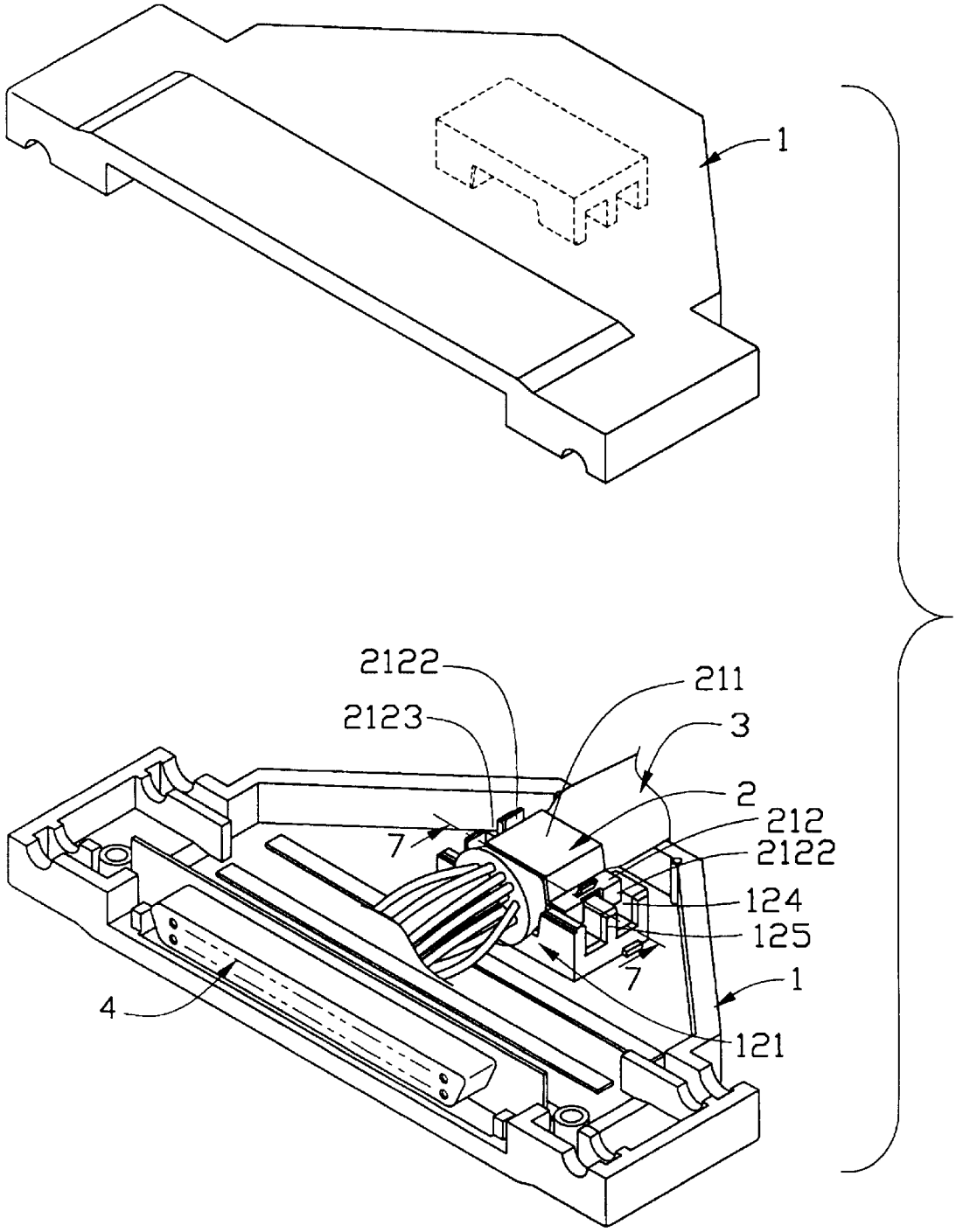
FIG. 5 is a partially assembled view of FIG. 2.
Figure 6:
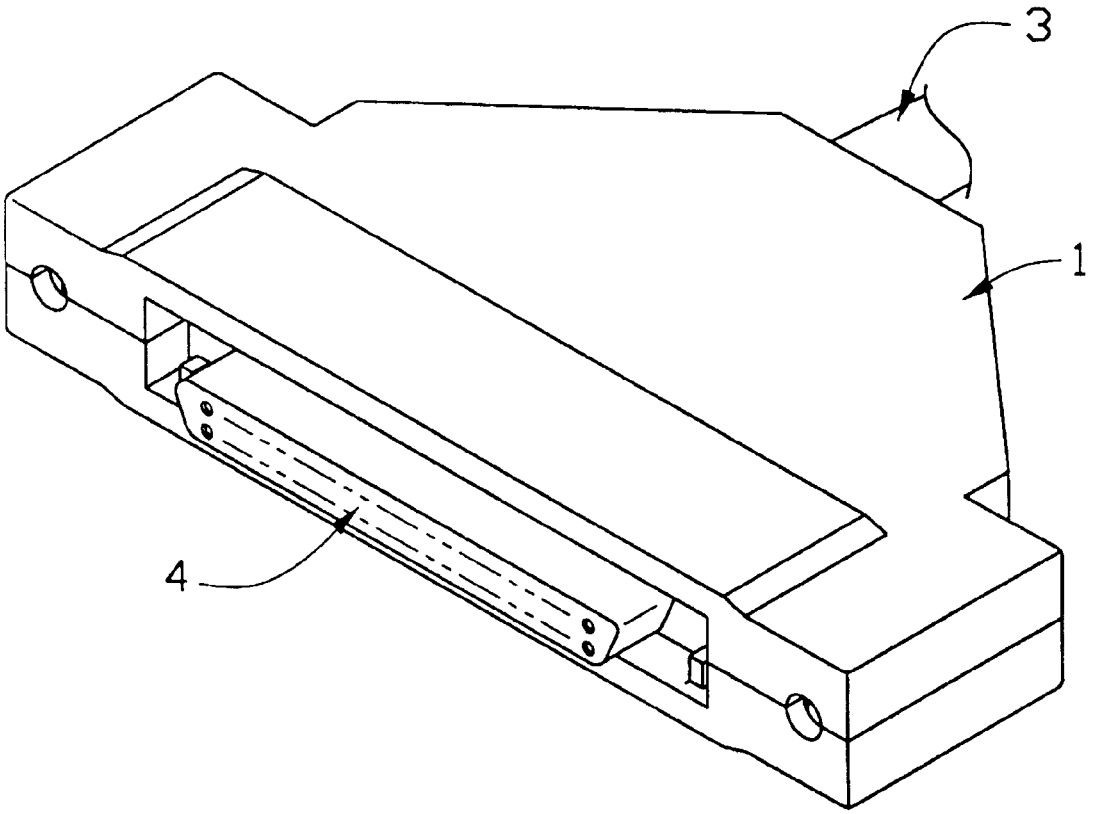
FIG. 6 is an assembled view of FIG. 2.
Figure 7:
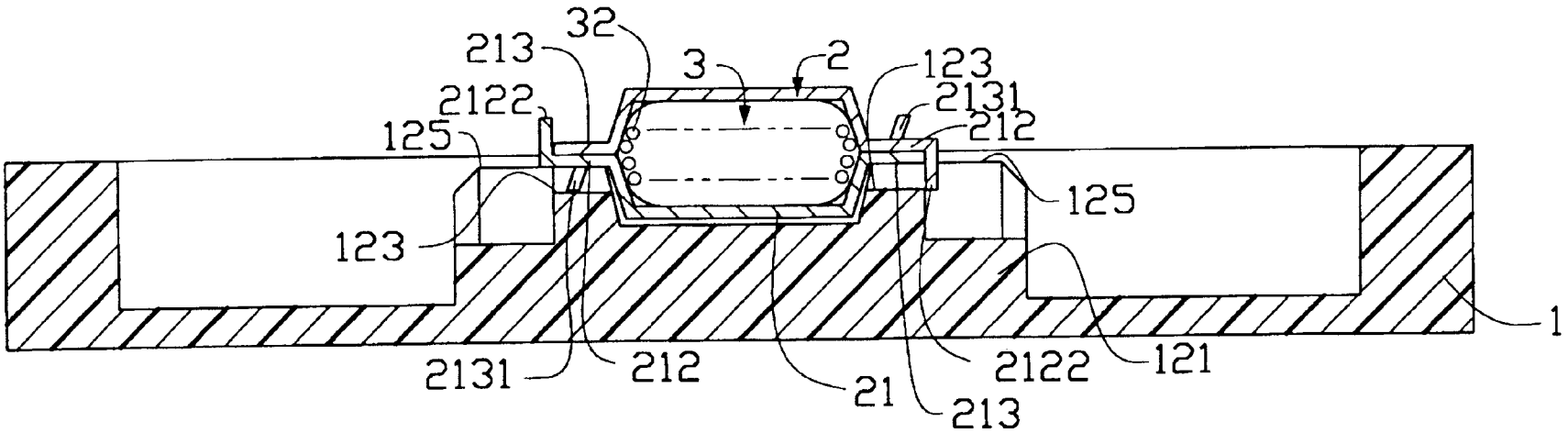
FIG. 7 is a cross-sectional view of the cable connector assembly taken along line 7—7 of FIG. 5.

Referring to FIG. 2, a cable connector assembly in accordance with the present invention comprises a main body 1, a clamp device 2, a cable 3, and a connecting portion 4. The body 1 comprises two substantially identical portions attached together. Each portion of the body 1 forms a receiving recess 11, a receiving space 12, and a U-shaped housing block 121 received in the receiving space 12 and defining a receiving passageway 122 therein. The receiving passageway 122 is defined on opposite sides by protruding walls 123. A seating block 125 is formed on a central portion of each wall 123 thereby defining two notches 124 on opposite sides thereof.

The clamp device 2 includes two similar clamp members 21. Each clamp member 21 includes a U-shaped clamping portion 211. A first side wing 212 and a coplanar second side wing 213 outwardly extend from opposite edges of the clamping portion 211. The first side wing 212 defines a slot 2121 through a central portion thereof. A pair of tabs 2122 upwardly extend from distal ends of an edge of the first side wing 212 opposite the clamping portion 211 thereby defining a cutout 2123 between the two tabs 2122. A protrusion 2131 formed by stamping, upwardly extends from a central portion of the second side wing 213. The protrusion 2131 of one clamp member 21 is inserted into the slot 2121 of the other clamp member 21 thereby engaging the two clamp members 21 together and forming the clamp device 2. An end portion 31 of the cable 3 is clamped between the clamping portions 211 and has an electrical portion 32 extending therefrom. The connecting portion 4 receiving a plurality of terminals (not shown) therein, which are electrically connected with the electrical portion 32 of cable 3, facilitates connection to a mating connector (not shown).

Referring now to FIGS. 3 to 7, in assembly, the end portion 31 of the cable 3 is positioned in the clamping portion 211 of one clamp member 21 and the other clamp member 21 is attached thereto by inserting the protrusion 2131 of each clamp member 21 into the corresponding slot 2121 of the other clamp member 21 whereby the cable 3 is sandwiched between the clamping portions 211 of the clamp members 21. The tabs 2131 are bent to strengthen the attachment of the clamp members 21 around the cable 3. The shape of the end portion 31 becomes deformed as the two clamping portions 211 are tightened therearound. Specifically, the cross sectional area of the end portion 31 of the cable 3 is decreased thereby facilitating adaptation to a cable connector assembly of reduced size. The electrical portion 32 of the cable 3 is electrically connected to the terminals of the connecting portion 4. The connecting portion 4 and the clamp device 2 are positioned in the receiving recess 11 and the housing block 121 of one portion of the main body 1, respectively. The clamping portions 211 of the clamp device 2 are received in the receiving passageway 122 of the housing block 121. The first and second side wings 212, 213 of the clamp device 2 abut against the walls 123 of the housing block 121, the tabs 2122 of the clamp device 2 are received in the corresponding notches 124 of the housing block 121, and the seating blocks 125 of the housing block 121 are received in the corresponding cutouts 2123 of the clamp device 2.

When an external force is exerted on the cable 3, the end portion 31 of the cable 3 will not become easily disengaged from the cable connector nor will damage easily be inflicted thereon due to the secure engagement between the clamp device 2, the cable 3, and the housing block 121. Finally, the other portion of the main body 1 is mounted to the counterpart portion. Thus, the assembly of the clamp device 2 of the present invention is simple, efficient, and substantial.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

I claim:

1. A cable connector assembly comprising:

a main body consisting of two halves each having a receiving space and a housing block located within the receiving space;

a cable having an end portion extending into the receiving space; and a clamp device having two opposed U-shaped clamping portions to be respectively securely received within the housing blocks, two coplanar side wings outwardly extending from opposite edges of each clamping portion, a slot defined through one of the side wings of each clamping portion, and a protrusion outwardly extended from the other wing of the clamping portion wherein the protrusion of each clamping portion is inserted through the corresponding slot of the other clamping portion for efficiently retaining the end portion of the cable between the clamping portions, and then each inserted protrusion is bent to strength the attachment of the clamping portions around the cable for adaptation to cables of different sizes.

2. The cable connector assembly as described in claim 1, wherein said housing block has a receiving passageway defined therethrough and the clamp device comprises a pair of clamping portions which together form an outer shape conforming to the receiving passageway.

3. The cable connector assembly as described in claim 1, wherein said receiving passageway is defined with two opposed walls, each wall having two notches defined therein and a seating block located between said notches, and a cutout is defined between a pair of tabs extending from one of the side wings of each clamping portion for receiving the seating block therein.

4. A cable connector assembly comprising:

a main body defining at least a receiving space therein, a housing block positioned adjacent to a rear end of said main body, and two opposed walls formed on the housing block, each defining a plurality of notches therethrough and a seating block located between each two notches;

a cable defining an end portion extending into said receiving space; and a clamp device having two opposed U-shaped clamping portions which are securable with each other for grasping and deforming the end portion of the cable extending into between the clamping portions, and two coplanar side wings outwardly extending from opposite edges of each clamping portion, and a cutout is defined between a pair of tabs extending from one of the side wings of each clamping portion wherein the tabs of at least one of the clamping portions are received within the corresponding notches of the housing block, and the seating block of the housing block are received within the corresponding cutouts of the at least one clamping portion thereby efficiently and easily positioning said clamp device within the housing block.

5. The cable connector assembly as described in claim 4, wherein said clamp device includes two members, and at least one member includes first means for securing to the other member, and second means for retaining to the housing block.

* * * * *